United States Patent [19]

Venaleck et al.

[11] 3,961,834

[45] June 8, 1976

[54] BOW CONTACT AND CONNECTOR USING THE SAME

[75] Inventors: John T. Venaleck, Painesville; John N. Tengler, Chardon, both of Ohio

[73] Assignee: A & P Products Incorporated, Painesville, Ohio

[22] Filed: June 19, 1974

[21] Appl. No.: 480,695

[52] U.S. Cl. ..... 339/176 M; 339/275 B

[51] Int. Cl.[2] ..... H01R 13/22; H01R 13/40

[58] Field of Search ..... 339/176, 217, 191, 192, 339/193, 194, 275 R, 275 B, 17

[56] References Cited

UNITED STATES PATENTS

| | | | |
|---|---|---|---|
| 332,336 | 12/1885 | Fee | 339/176 P |
| 3,129,990 | 4/1964 | Rice et al. | 339/17 LM |
| 3,300,686 | 1/1967 | Johnson et al. | 339/17 R |
| 3,475,717 | 10/1969 | Lane | 339/75 MP |
| 3,634,806 | 1/1972 | Fergusson | 339/17 F |
| 3,671,917 | 6/1972 | Ammon et al. | 339/17 L |

FOREIGN PATENTS OR APPLICATIONS

| | | | |
|---|---|---|---|
| 96,750 | 7/1960 | Norway | 339/176 M |

*Primary Examiner*—Roy Lake
*Assistant Examiner*—Neil Abrams
*Attorney, Agent, or Firm*—Donnelly, Maky, Renner & Otto

[57] ABSTRACT

A bow contact has a gradually curved bow portion coupled by a reverse curved transition portion to a substantially linear attaching portion, and in free unstressed condition the latter portion defines an acute angle with a line drawn between the opposed remote ends of the contact, whereby when the contact is deformed to position the attaching portion in flat abutting engagement with a support surface creating a prestressed moment in the transition portion a region of zero moment is established in the attaching portion, which remains at zero moment and in flat abutting engagement with the support surface over a wide range of deformations of the bow portion. The bow contacts may be incorporated in an electrical connector arrangement to provide connections between respective conductors of a multiple conductor electrical cable and corresponding connector pins of a male electrical connector, for example, using a printed circuit board interface, and may similarly be incorporated in an output connector for a printed circuit board.

20 Claims, 8 Drawing Figures

Fig. 1
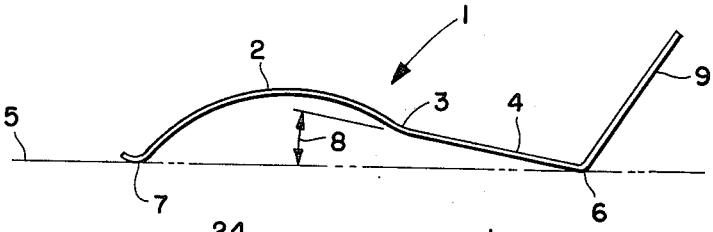
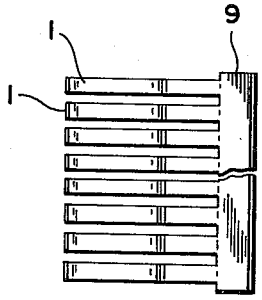
Fig. 2
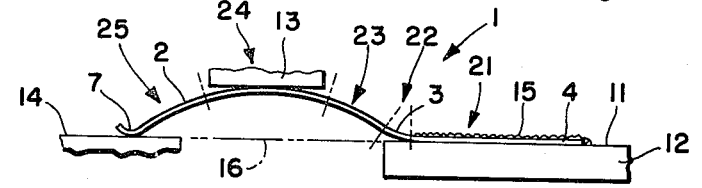
Fig. 3
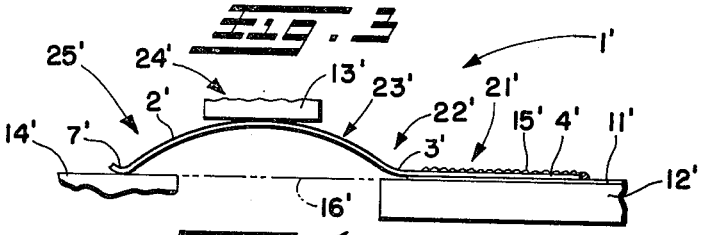
Fig. 4
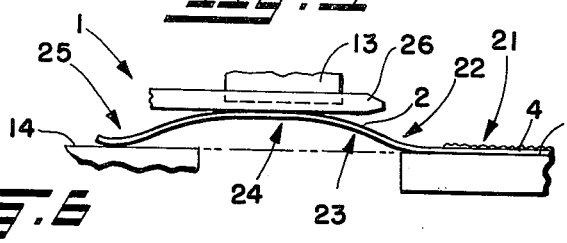
Fig. 6
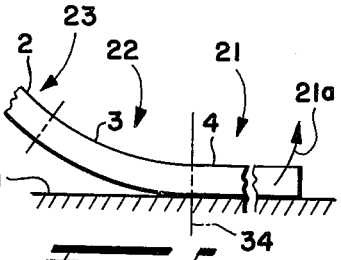
Fig. 5
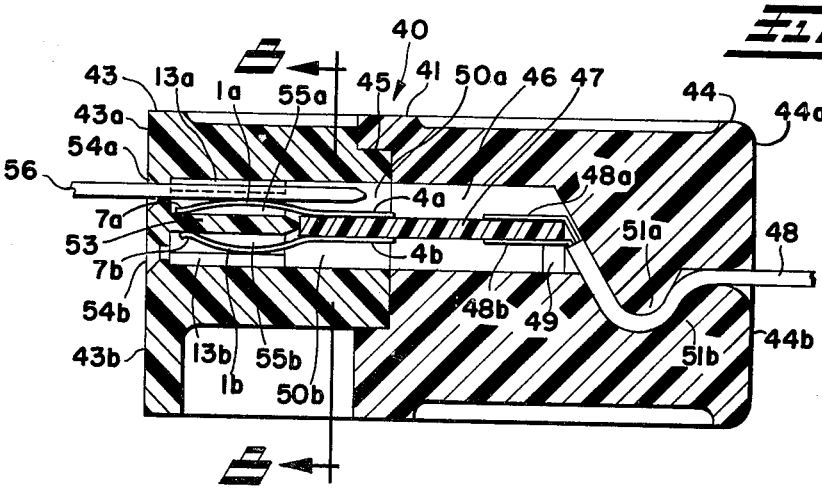
Fig. 7
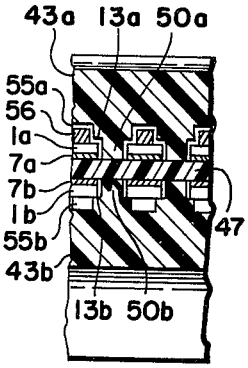
Fig. 8

BOW CONTACT AND CONNECTOR USING THE SAME

BACKGROUND OF THE INVENTION

This invention relates to a bow contact having an attaching portion for solder connection to a substrate against which such portion lies flat and at zero stress over a wide range of contact conditions. Moreover, the invention relates to a printed circuit board output connector or electrical cable termination connector device including a printed circuit board interface and which utilizes a plurality of such improved bow contacts for electrical connection between the latter and respective inserted connector pins while providing force balance between pin rows and having a relatively high compliance factor.

It is desirable to connect conductors in one electrical cable to connector pins or the like to which are already attached other conductors, and such connection should preferably be accomplished in an uncomplicated, facile manner using a printed circuit board interface. Accordingly, it is necessary to provide a durable and flexible method for connecting such connector pins, especially those aligned in rows in a male plug-type electrical connector, to circuits on such printed circuit board.

SUMMARY OF THE INVENTION

Briefly described, the invention comprises a bow contact for connecting connector pins to circuits on a printed circuit board and to a connector using such contacts. The bow contact has a relatively gradually curved bow portion, i.e. having a relatively large radius of curvature, coupled by a reverse sharper curved transition portion, i.e. having a relatively smaller radius of curvature, to a linear attaching portion. The bow contact is so formed that when standing in free unstressed condition an acute angle is defined between the attaching portion and a line drawn between the remote ends of the same and the bow portion, the latter constituting the forward support of the contact. Moreover, it has been found that when the contact is supported at both ends and a force is applied to the bow portion to deform the attaching portion into abutment with a substrate planar support surface, such as a terminal pad on a printed circuit board for electrical connection thereto, the transition portion becomes prestressed and will have a relatively large moment therein while the attaching portion is maintained at zero moment over a relatively large range of applied forces to and deformations of the bow portion.

The gradual curve and the freedom of movement of the forward contact support results in a high compliance factor for the contact when used in a socket-type connector for effective operation over a relatively wide range of plug connector parameters, and a relatively small angle of repose, defined by the tangent to the curve of the bow portion first contacted by an inserted connector pin and the longitudinal axis of such pin, makes the same insensitive to insertion problems created by misaligned or over-sized connector pins. Also, by arranging the bow contacts in the connector in opposed rows, the forces exerted by the same on inserted connector pins are balanced between the pin rows for increased effectiveness of electrical connection thereto. The maintenance of the attaching portion flat against the substrate, and accordingly, at zero stress over a wide range of bow deformations substantially decreases the occurrence of solder creep at the solder connection of the attaching portion to the printed circuit board to increase the durability and longevity of the contact and connector in which it is used. Moreover, the bow contact may be coupled to a printed circuit board to facilitate connection to circuits thereon by external device, and may be used in various types of electrical connector devices, such as multiple conductor cable terminations, or the like.

Accordingly, a primary object of the invention is to provide an electrical contact improved in the noted respects.

Another object of the invention is to eliminate the stress at the solder joint connection between a bow contact and a planar surface to which it is attached.

A further object of the invention is to maintain the attaching portion of a bow contact flat and at zero stress while the bow portion thereof is deformed over a relatively wide range.

An additional object of the invention is to reduce and/or to eliminate solder creep at the connection of a bow contact to a substrate.

Still another object of the invention is to provide a bow contact having a relatively high compliance factor.

Still an additional object of the invention is to provide a bow contact which is easily manufactured and attached to a printed circuit board or other support.

Still a further object of the invention is to provide a bow contact which can be constituted primarily only in two dimensions, the third dimension being selectively variable for positioning to receive electrical connector pins at any desired spacing.

Yet another object of the invention is to facilitate adapting the bow contact for electrical connection with connector pins of varying sizes.

Yet an additional object of the invention is to increase the contact area between a bow contact and an electrical connector pin.

Yet a further object of the invention is to provide a connector device utilizing the bow contact of the invention for providing a termination for a multiple conductor electrical cable, printed circuit board, or the like, which has a high compliance factor and a small angle of repose being insensitive to insertion problems such as connector pin misalignment, provides a force balance between pin rows, and is durable and long-lasting.

These and other objects and advantages of the instant invention will become apparent as the following description proceeds.

To the accomplishment of the foregoing and related ends, the invention, then, comprises the features hereinafter fully described in the specification and particularly pointed out in the claims, the following description and the annexed drawing setting forth in detail a certain illustrative embodiment of the invention, this being indicative, however, of but one of the various ways in which the principles of the invention may be employed.

BRIEF DESCRIPTION OF THE DRAWING

FIG. 1 is a side elevation view of a bow contact in free, unstressed condition;

FIG. 2 is a plan view of a plurality of bow contacts coupled by a break away stub;

FIGS. 3 and 4 are side elevation views of a bow contact attached to a printed circuit board;

FIG. 5 is a side elevation view of a portion of a bow contact in accordance with the invention;

FIG. 6 is a side elevation view of a bow contact in electrical connection with a connector pin;

FIG. 7 is a section view of a female cable termination cable connector including the improved bow contacts of the invention; and FIG. 8 is a section view of a portion of the connector of FIG. 7 looking in the direction of arrows 8—8.

DESCRIPTION OF THE PREFERRED EMBODIMENT

Referring now to the drawing, wherein like reference numerals refer to like parts in the several figures, and particularly to FIG. 1, the bow contact of the invention is indicated generally at 1. The bow contact 1 includes a gradually curved bow portion 2 coupled by a reverse curved transition portion 3 to a substantially linear attaching portion 4. The bow contact 1 is illustrated in FIG. 1 standing on a planar surface indicated by the line 5, whereby in free, unstressed condition the bow contact rests on the remote ends, 6, 7 of the same, the remote end 7 of the bow portion 2 constituting a forward movable support portion for the bow contact. Moreover, in such free, unstressed condition of the bow contact an acute angle 8 is defined between the attaching portion 4 and the plane 5.

Although the bow contact 1 is illustrated in a side elevation view in FIG. 1, whereby only a single contact is seen, a plurality of parallel spaced bow contact strips may be formed as a single unit attached together by a breakaway stub 9, as shown, for example, in FIG. 2 on a smaller scale than FIG. 1. Thus, the spacing of respective bow contacts may relate to the spacing of respective printed circuit terminal pads on a printed circuit board, whereby bow contacts may be positioned relative to such terminal pads and conveniently soldered in place after which the breakaway stub 9 may be broken away for electrical isolation between each of the joined contacts and terminal pads.

In one version of the bow contact the material constituting the same way may be berylium copper having a thickness of approximately six thousandths inch and plated with a two ten thousandths inch tin lead coating. When such a bow contact is attached to a printed circuit terminal pad of approximately two thousandths inch thickness on a printed circuit board substrate, the thickness of such terminal pad is relatively negligible compared to that of the bow contact. The bow contact 1 is illustrated in FIG. 3 in attachment with a printed circuit terminal pad 11, which is printed on a printed circuit board substrate 12. Since the thickness of the printed circuit is negligible with respect to that of the bow contact, the former is not visible in FIG. 3, although it is shown disproportionately in FIG. 4, wherein primed reference numerals designate parts corresponding to those of FIG. 3, as surface 11′.

Referring now particularly to FIG. 3, the attaching portion 4 of the bow contact is in flat abutting relation with the surface 11, such relationship having been effected by a bias stop element 13 applying a bias force to the bow portion 2 of the contact 1 and the forward movable support portion 7 has been allowed to move freely on the support surface 14, which may or may not be an integral part of the printed circuit board substrate 12 provided the surfaces of the latter and the support surface 14 are approximately coplanar. The attaching portion 4 is covered over with a layer of solder 15 to hold the same in place on the terminal pad 11 while leaving the forward movable support portion 7 free to move along the surface 14 as the bow portion 2 of the contact is further deformed, for example, by insertion of a connector pin into connection therewith.

Exertion of the bias force on the bow portion 2 of the bow contact 1 to flatten the attaching portion 4 against the surface 11 pre-stresses the transition portion 3 to effect a moment therein, which moment will not be relieved until the bow portion 2 is substantially flattened or deformed in a direction toward the line 16 in the plane of the surfaces 11, 14.

As illustrated in FIG. 3, the bow contact 1 has a number of functionally inter-related regions, including a region of zero moment 21, a region of moment 22, a coupling region 23, a region of contact 24, and a region of free moving support 25, the dashed lines in the figure indicating the juncture of two adjacent regions. Moreover, in FIG. 5 the region of zero moment 21 and region of moement 22 are illustrated relative to a support surface 11*A* the zero and existing moment forces being indicated, respectively, by arrows 21*a*, 22*a*. The sum of the lengths of the regions 21, 22 will remain constant, although relative to each other the individual lengths may vary as the bow portion 2 is further deformed, which tends to flatten a portion of the latter region into abutment with the surface 11*A* lengthening the former region and shortening the latter region, the line 34 indicating the juncture of the two regions. The coupling region 23 flexes as the region of contact 24 is flattened when, for example, a connector pin is inserted into engagement with the latter to provide a large surface area of connection between the same, and the movable support region 25 is curved upward at its remote end to avoid any sharp points digging into the support surface 14 as such region moves to facilitate flattening of the region of contact during such insertion.

The deformation of the contact 1 when engaged by a connector pin 26 is illustrated in FIG. 6, whereby such pin causes the bow portion 2 to flatten substantially creating a relatively large region of contact 24, while the region of movable support 25 moves to the left, as shown in the figure, the coupling region 23 deforms to provide for such flattening, the region of moment 22 decreases in length and the region of zero moment 21 increases in length. Moreover, flattening of the bow contact also tends to relieve some of the pre-stressed moment in the region of moment 22; however, as long as the contact remains within its deformable limit, no moment will be created in the region of zero moment, and the attaching portion 4 will remain flat against the surface 11*b*.

In one tested version of the invention a bow contact was formed of six thousandths inch thick berylium copper half hardened at 550°F. for four and one-half hours having an acute angle designated 8 in FIG. 1 of approximately ten degrees forty minutes. By loading the bow portion 2 of such contact with approximately 10 ounces of force, the height of the bow portion dropped from sixty thousandths inch to forty-seven thousandths inch above the printed circuit board support surface 11 to deform the attaching portion 4 in flat abutment with the latter. Moreover, the attaching portion 4 remained in abutment with the surface 11 until the force applied to the bow portion exceeded approximately 30 ounces and the distance of the bow portion above the surface had decreased to approximately twenty-eight thousandths inch. Thus, it can be seen from the foregoing example that the attaching portion of the tested bow contact remained at zero moment while the force on the bow portion was varied over a range of 20 ounces and the deformation of the bow portion relative to the support surface was varied over a range of approximately twenty thousandths inch. Thus, by preloading the bow portion of the contact by a force of approximately 10 ounces by a bias stop element 13, for example, the attaching portion 4 will be maintained in flat abutting contact with the support surface 11 without the insertion of the connector pin 26, shown in FIG. 6, whereby even without insertion of the connector pin the attaching portion 4 remains flat and does not contribute to solder creep.

The width of the bow contact has been found not to be critical for effective operation with a determination of such parameter being primarily based on convenience, efficiency, environment and the like. Moreover, the length of the bow contact may be determined by intended range of connector pins to be engaged therewith so long as the bow portion curve is gradual and the transition protion is reverse curved. Thus, the bow contact 1 has only two critical dimensions, i.e. (1) thickness for determining flexibility and elasticity and (2) length for determining connector pin size range to be accommodated.

Turning now more particularly to FIGS. 7 and 8, a connector 40 incorporating bow contacts 1*a*, 1*b* of the type described above is illustrated in cross-section in the former with a portion of the connector for retaining a pair of bow contacts being illustrated in section in the latter. The connector 40 is formed, for example, of an electrically non-conductive material, such as plastic or other phenolic material and comprises, as illustrated, a main housing 41 divided into forward and rear ends 43, 44, each having respective upper and lower halves 43*a*, 43*b* and 44*a*, 44*b*. The front end 43 may consist of a single molded piece or of a plurality of molded pieces fastened together. The front and rear ends of the housing 41 are coupled together at 45, for example, by screw fasteners, adhesive material, or the like, not shown.

Within an opening 46 in the housing 41 is located a printed circuit board 47 on which a plurality of electrically conductive paths, not shown, are printed, either in direct line or to fan in or to fan out between respective conductors 48*a*, 48*b* from a multiple conductor electrical cable 48 and respective attaching portions 4*a*, 4*b* of respective bow contacts 1*a*, 1*b*, which are preferably soldered on respective terminal pads on the printed circuit board 47. The printed circuit board is retained in the opening or channel 46 on a support 49 and by shoulder supports 50*a*, 50*b* of the front end halves 43*a*, 43*b*. Moreover, a pair of strain relief mating portions 51*a*, 51*b* provide for retention of the electrical cable 48 in the connector 40 in conventional manner.

The bow contacts 1*a*, 1*b* are supported at their forward movable support portions 7*a*, 7*b* by a rib 53 defined between the upper and lower halves of the front end 43 of the connector, and respective bias shoulders 13*a*, 13*b* provide the pre-stress bias force to the bow portions of the bow contacts 1*a*, 1*b* to maintain the attaching portions 4*a*, 4*b* thereof flat against the respective terminal pads on the printed circuit board 47 to which they are attached. Moreover, a pair of openings 54*a*, 54*b* provides access to a pair of slots 55*a*, 55*b* which define connector pin receiving cavities, whereby a connector pin 56 inserted therein abuts the bow contact 1*a* causing the same to flatten and to deform away from the contact bias shoulder 13*a* providing a large area of contact between the two as the forward movable support portion 7*a* moves to the left in the figure and the attaching portion 4*a* remains at zero moment precluding application of stress to the solder attaching the same to the printed circuit board 47.

Although the bow contacts 1*a*, 1*b* are illustrated in FIG. 7 attached to a printed circuit board 47 which forms part of the connector structure 40 as a termination to the electrical cable 48, the bow contacts may similarly be used to provide a direct connection to circuits formed on a printed circuit board by itself. In such configuration the rear end 44 of the housing 41 would be eliminated, the printed circuit board 47 would likely be extended at some length to the right in the figure for a more appropriate scale relative to the size of the bow contacts 1*a*, 1*b*, and the front end 43 of the housing would be otherwise similarly positioned with respect to the printed circuit board 47, whereby the respective bow contacts would be attached and electrically coupled to respective circuits on the printed circuit board and insertion of connector pins 56 into respective openings 54 would provide for direct connection to such printed circuits. Moreover, although the invention is shown and described in FIG. 7 with reference to a single pair of contacts located on opposite surfaces of a printed circuit board, the number of such parallel bow contact connections used in a connector or printed circuit board connector arrangement may be extended almost indefinitely as illustrated, for example, in FIG. 2.

The gradual curve on the bow portion 2 of the contact 1 provides a high degree of compliance for connection with misaligned connector pins whereby were the connector pin 56 illustrated in FIG. 7 to be inserted at an angle through the opening 54*a*, such connector pin would be sure to make contact with the bow contact 1*a*. For example, if the pin were bent downward, it would abut the bow portion of the contact and be slid or urged upward at the urging of the bow contact itself, which in its macimum deflected position is still supported by the rib 53. Alternatively, if the connector pin 56 were bent upwards in the FIG. 7 illustration, the depth of the connector pin receiving opening 55*a* is such that the connector pin would still be urged into connection with the bow contact.

Moreover, the opposed bow contacts on opposite surfaces of the printed circuit board 47 provides a force-balancing between opposed respective connector pins to balance effectively the forces exerted on respective connector pins located in parallel rows in a male cable termination, thus providing overall good electrical connections between respective connector pins and bow contacts. Finally, by utilizing such bow contacts having a relatively large range of deformations which can be undergone by the bow portions thereof, the bow contacts may easily receive connector pins having a range of sizes; also, by varying the amount of prestressing of the bow contact by the bias shoulder 13, the length of the attaching portion 4 of the bow contact may be varied before soldering, thus correspondingly increasing or decreasing the pre-stress moment in the region of moment or transition portion 3 for accommodating connector pins of predetermined ranges of size.

We claim:

1. An electrical contact adapted for attachement to a substantially planar surface, comprising a deformable curved bow portion, and a substantially linear attaching portion, the contact having first and second ends at remote parts of said bow portion and said attaching portion respectively, said attaching portion defining an acute angle with a line drawn between said ends when the contact is unstressed, and while the contact is supported at said ends said attaching portion being deformable to a substantially planar abutting relation with such a surface, the contact also comprising transition portion means coupling said bow and attaching portions for maintaining said attaching portion under zero stress as a region of zero moment when said attaching portion has been so deformed to such a substantially planar abutting relation with such a surface while said first end remains so supported and while said bow portion is deformed within a predetermined range.

2. An electrical contact as set forth in claim 1, further comprising means for attaching said attaching portion to such substantially planar surface.

3. An electrical contact as set forth in claim 2, wherein said means for attaching comprises solder, whereby the maintenance of zero moment at said attaching portion substantially eliminates the occurrence of solder creep.

4. An electrical contact as set forth in claim 1, wherein said bow portion comprises a gradually curved bow portion.

5. An electrical contact as set forth in claim 1, wherein said transition portion means is reverse curved relative to the curvature of said bow portion and the curvature of said transition portion means being relatively sharper than that of said bow portion.

6. An electrical contact as set forth in claim 1, wherein said first end is further reverse curved relative to the major extent thereof to facilitate sliding along a support when said bow portion is deformed.

7. An electrical contact as set forth in claim 1, and further comprising in combination therewith bias means for deforming said electrical contact for engagement of said attaching portion with such substantially planar surface.

8. An electrical contact as set forth in claim 7, and further comprising in combination therewith means for supporting said first end for free sliding movement thereof when said bow contact is deformed within such predetermined range.

9. An electrical contact as set forth in claim 1, wherein said contact comprises strip material.

10. An electrical connector, comprising a housing; a support surface having at least a portion positioned within said housing; a plurality of bow contacts attached to said support surface, each bow contact comprising a deformable curved bow portion, a reverse curved transition portion, and a substantially linear attaching portion, said reverse curved transition portion coupling said bow portion to said transition portion, each bow contact having first and second ends respectively at remote parts of said bow portion and said attaching portion, said attaching portion when in free unstressed condition defining an acute angle with a line drawn between said ends of said bow contact, the electrical connector also including means stationarily located in said housing for movably supporting said first end, and said bow contact being deformable while said first end is so movably supported to place said attaching portion in a substantially planar abutting relation with said support surface for attachment thereto and to create a pre-stressed region of moment in said transition portion thus maintaining said attaching portion under zero stress as a region of zero moment when said bow portion is deformed within a predetermined range; and means in said housing for applying force to said bow portions between the first end and the transition portion thereof to pre-stress said bow contacts to maintain the attaching portions thereof in flat abutting engagement with said support surface.

11. An electrical connector as set forth in claim 10, further comprising at least one opening in said housing for providing access to said bow contacts, whereby respective pin connectors may be inserted through said at least one opening for engagement with corresponding bow contacts.

12. An electrical connector as set forth in claim 10, said means for movably supporting comprising means in said housing for supporting said first end of each of said bow contacts for free sliding movement thereof when the respective bow contact is deformed within such predetermined range.

13. An electrical connector as set forth in claim 10, wherein said housing comprises a single molded piece.

14. An electrical connector as set forth in claim 10, wherein said housing comprises plural pieces coupled together.

15. An electrical connector as set forth in claim 10, wherein said housing comprises forward and rear portions coupled together, and means in said housing for providing an electrical connection between respective bow contacts and electrical conductors of a multiple conductor electrical cable in said housing.

16. An electrical connector as set forth in claim 15, wherein said means for providing comprises a plurality of conductive paths printed on said support surface.

17. An electrical connector as set forth in claim 15, wherein bow contacts are positioned on both sides of said support surface.

18. An electrical connector as set forth in claim 15, further comprising a strain relief means in said rear end of said housing for retaining an electrical cable therein.

19. An electrical connector as set forth in claim 10, wherein said support surface comprises a printed circuit board, and said bow contacts are attached to respective printed circuits on said board.

20. An electrical connector as set forth in claim 19, wherein bow contacts are attached to both sides of said printed circuit board.

* * * * *